US006390809B1

(12) United States Patent
Gerace

(10) Patent No.: US 6,390,809 B1
(45) Date of Patent: May 21, 2002

(54) CHILD RESISTANT SELF IGNITING HAND HELD LIGHTER

(76) Inventor: Joseph L. Gerace, 10821 Claridge St., Westchester, IL (US) 60154

( * ) Notice: Subject to any disclaimer, the term of this patent is extended or adjusted under 35 U.S.C. 154(b) by 0 days.

(21) Appl. No.: 09/546,018

(22) Filed: Apr. 10, 2000

(51) Int. Cl.[7] ..... F23D 11/36
(52) U.S. Cl. ..... 431/153; 431/255; 431/344
(58) Field of Search ..... 431/255, 143, 431/264, 265, 131, 344, 155, 277, 275, 133, 136, 139, 140

(56) References Cited

U.S. PATENT DOCUMENTS

| | | | | |
|---|---|---|---|---|
| 1,076,583 A | * | 10/1913 | Klugel | 431/344 |
| 4,538,983 A | * | 9/1985 | Zeller et al. | 431/255 |
| 4,869,663 A | | 9/1989 | Fremund | |
| 5,199,865 A | * | 4/1993 | Liang | 431/255 |
| 5,215,458 A | | 6/1993 | Cirami | |
| 5,326,256 A | | 7/1994 | Shike et al. | |
| 5,332,387 A | | 7/1994 | Sheng | |
| 5,460,521 A | | 10/1995 | Tsai | |
| 5,645,415 A | | 7/1997 | Hamel | |
| 5,681,161 A | | 10/1997 | Ribot | |
| 5,697,775 A | | 12/1997 | Saito et al. | |
| 5,738,507 A | | 4/1998 | Mifune et al. | |
| 5,934,895 A | | 8/1999 | McDonough et al. | |

* cited by examiner

*Primary Examiner*—James C. Yeung
(74) *Attorney, Agent, or Firm*—Patula & Associates, P.C.

(57) ABSTRACT

A child safety device in a hand held lighter comprises a rotatable barrel section and a release button. The child safety device requires that a user of advanced dexterity and hand eye coordination push a trigger or release button while contemporaneously therewith rotating the barrel section. Rotation of the barrel section allows for aligning of fuel line sections so that when aligned and the trigger mechanism is depressed, the flammable substance is allowed to flow to the firing chamber at the nozzle. After each depressing and release of the trigger, the barrel section returns to its first position, and the user must re-rotate the barrel section to re-light to lighter.

18 Claims, 11 Drawing Sheets

CHILD RESISTANT SELF IGNITING HAND HELD LIGHTER

The present invention generally relates to general purpose utility lighters, such as those used to ignite candles, barbecue grills, fireplaces, and campfires, and in particular to a lighter having a safety device. Specifically, the present invention related to a child resistant, self-igniting hand held lighter.

BACKGROUND OF THE INVENTION

The instant invention provides a mechanism to reduce the likelihood of dangerous and oftentimes deadly fires by implementing a child resistant device on hand held lighters, specifically, those used in the lighting of candles, barbecue grills, fireplaces, and campfires. Such hand held lighters are well described in the art, such as in U.S. Pat. No. 5,738,507 to Mifune et al. Protection against child use is achieved with the present invention by implementing a device that requires dexterity and hand-eye coordination of an advanced age.

Dangers associated with children and fire are well known. Dangerous and oftentimes fatal fires often result when children play with or attempt to use hand held lighters. Deadly fires often result because present hand held lighters of the type identified do not sufficiently guard against use by young children. The present invention addresses these problems and others which may also be associated with the known art.

Furthermore, hand held lighters are typically disposable, meaning that once the fuel runs out of the tank, the lighters are thrown away. This forces a user to continually purchase new lighter each time the old one runs out. Therefore, there exists a need for a reusable lighter which also meets the standards of child safety. Accordingly, the present invention fulfills these needs and provides a more efficient, cost effective, and safer lighter for the consumer.

Heretofore, there does not exist in the art a child resistant device for hand held lighters of the type identified that requires hand-eye coordination and dexterity of an advanced age working in concert to engage the flaming device.

Prior attempts to provide sufficient child safety features for hand held lighters have failed to appreciate the important aspects which the present invention fully encompasses. U.S. Pat. No. 5,645,415 entitled "Child-Proof Gas Lighters and Pens Therewith," issued to Hamel represents such a prior attempt. Hamel teaches a child proof device comprising an interfering piece displaceable to jam a lever for opening a gas valve in a lighter. Hamel does not teach, disclose, suggest, or make obvious a device requiring two hands to operate in conjunction to rotate and hold a firing chamber with one hand while simultaneously pushing a release valve with the second hand.

Other attempts to provide sufficient child safety features for lighting devices have likewise failed to appreciate the important aspects of the present invention, such as U.S. Pat. No. 5,697,775 issued to Saito et al. entitled "Safety Device in Lighting Rods"; U.S. Pat. No. 4,869,663 issued to Fremund entitled "Child Proof Cigarette Lighter"; U.S. Pat. No. 5,215,458 issued to Cirami entitled "Child-Resistant Lighter with Spring-Based, Rotatable Safety Release"; U.S. Pat. No. 5,460,521 issued to Tsai entitled "Injection Igniter Having a Safety Device"; and U.S. Pat. No. 5,332,387 issued to Shena entitled "Cigarette Lighter." None of the aforementioned references discloses, suggests, motivates, or teaches a device with safety features that require dexterity or skill of an advanced age equaling that of the present invention. The aforementioned references incorporate "safety" features aimed against the inadvertent lighting or release of flammable substances, but do not guard against use by a young, immature child to the extent and in the improved manner that the present invention provides.

It is therefore an object of the instant invention to provide a means to protect against use of a hand held lighter by a child. In other words, the hand held lighter cannot be engaged advertently or inadvertently by a person without the two-handed dexterity and hand-eye coordination typically associated with a person of advanced age. By requiring a de minimus level of hand-eye coordination and two-handed dexterity, the instant invention helps to protect against young children igniting dangerous and oftentimes fatal fires.

It is a further object of the instant invention to have a hand held lighter that requires release of the safety features before each attempted use. This protects against use of the hand held lighter by a child who either disengages one of the safety features through happenstance or by a child who attempts to use a hand held 1t lighter found with the child safety features having at one time been disengaged.

SUMMARY OF THE INVENTION

The above and other objects of the instant invention are accomplished by providing a child safety device for a hand held lighter as described herein. The hand held lighter comprises a main body, a trigger mechanism, a base having a fuel tank containing a flammable substance (fuel), and a barrel section. Incorporated therein is a child safety device preferably comprising a rotatable barrel section and a release/lock means associated with the trigger mechanism and the barrel section. Generally, the rotating barrel must be unlock and rotated to an operable position while the trigger is being depressed.

In a first embodiment, a first locking bar, operatively connected to the trigger mechanism, engages the rotatable barrel preventing rotation. When the trigger mechanism is depressed slightly, the first locking bar disengages from the rotatable barrel. At the same time, a second locking bar operatively linked to the trigger mechanism is moved toward engagement of the rotatable barrel. If the rotatable barrel is not rotated, the second locking bar will engage the rotatable barrel when the trigger mechanism is fully depressed, again locking the rotating barrel in its non-operable position. If the barrel is rotated to its operable position while the trigger is slightly depressed, then fully depressing the trigger will temporarily lock the rotating barrel in its operable position.

In a second embodiment, the user depresses a push-button release with one hand, unlocking the trigger mechanism and unlocking a locking means which selectively locks the rotatable section. With a second hand the user rotates the rotatable section to a second position and then releases the push-button release. Rotating the rotatable section, against an urging means, to the second position or operable position aligns a fuel line in the main body with a fuel line section in the rotatable barrel section. Furthermore, releasing the push-button release re-locks the rotatable section, via the locking means, in the second position. The trigger mechanism being unlocked may now be depressed, releasing the fuel through the aligned fuel lines and being ignited at the nozzle. When the trigger mechanism is released, a releasing means unlocks the locking means, whereupon the urging means rotates the rotatable section back to the first position or non-operable position, un-aligning the fuel lines. This process must then be repeated in order to fire the lighter again.

In another embodiment of the present invention, the lighter is provided with a fuel access port to allow the lighter to be refueled. In this embodiment, the lighter incorporates a fuel measuring device for measuring and indicating the amount of fuel left in the lighter. In the case of liquid fuel, a view window in the main body and fuel tank can be provided in order to visually determine the amount of fuel left in the fuel tank. In the case of gaseous fuel, a fuel meter can be incorporated into the fuel tank. The fuel access port allows the user to re-fill the fuel tank when emptied or low.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

In the following description, similar components are referred to by the same reference numbers in order to simplify the understanding of the sequential aspect of the drawings.

DETAILED DESCRIPTION OF THE PREFERRED EMBODIMENTS OF THE PRESENT INVENTION

Figure 1:
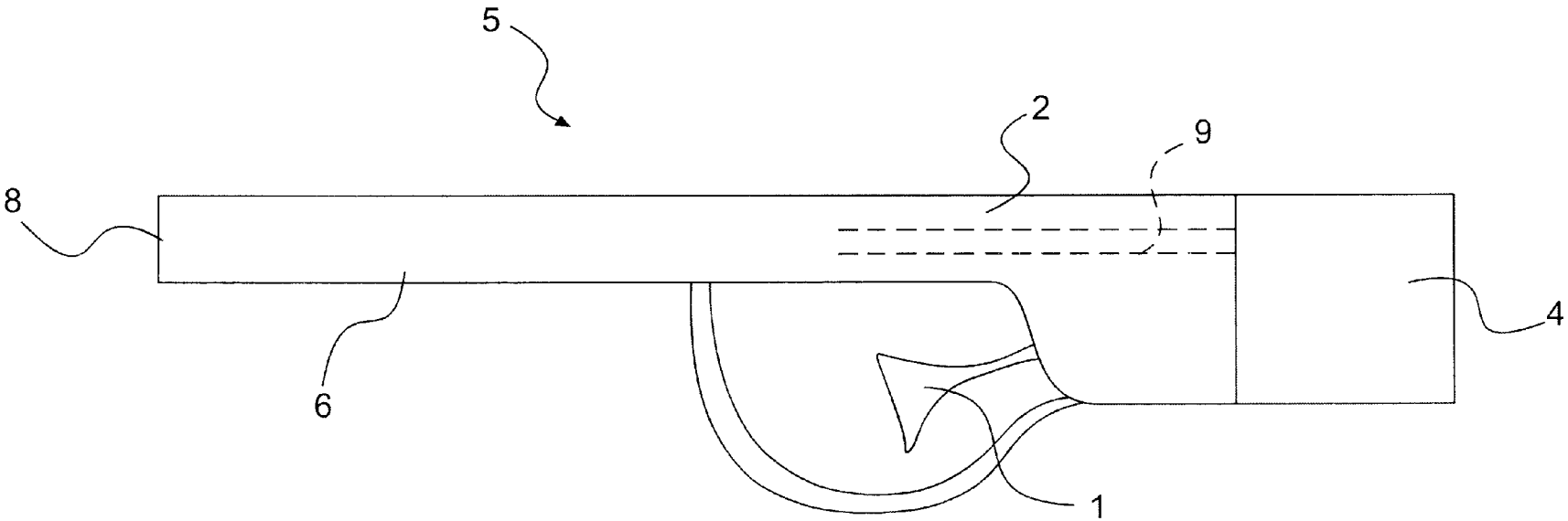
FIG. 1 PRIOR ART
FIG. 1 is a profile view of a prior art lighter.

While the invention is susceptible of embodiments in many different forms, there is shown in the drawings and will be described herein, in detail, the preferred and alternate embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, a prior art hand held lighter 5 is shown. The hand held lighter 5 has a trigger mechanism 1, a main body 2, a base 4, and a barrel 6 with an accompany nozzle 8. In accordance with the prior art, the base 4 houses a fuel tank which stores fuel therein (not shown). The fuel tank is opened and closed by the trigger mechanism 1. The fuel flows from the tank through a fuel line 9 (partially shown in phantom) where it is ignited at the nozzle 8. The ignition mechanism housed at the nozzle 8 is of the type disclosed and shown in known hand held igniters in the prior art.

Figure 2:
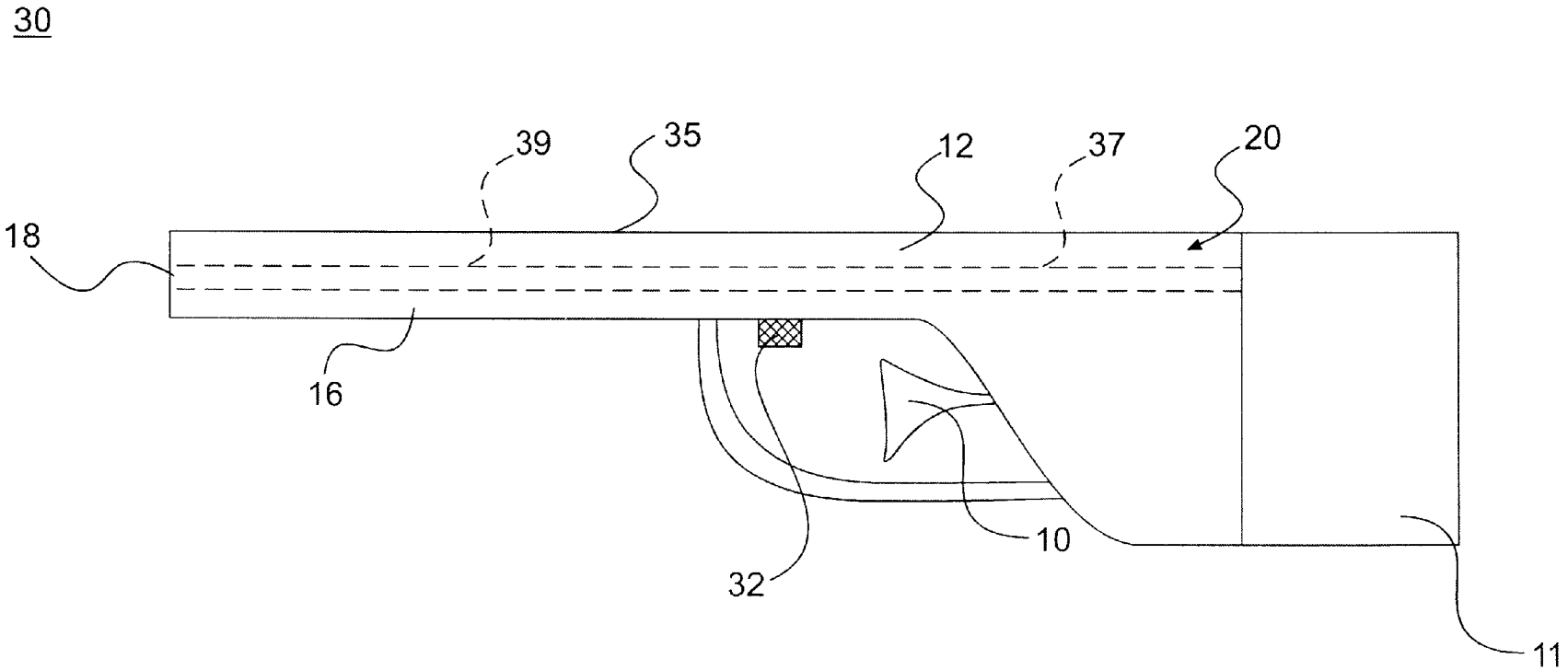
FIG. 2 is a profile view showing a hand held lighter in accordance with the present invention.

Referring now to FIG. 2 there is shown one embodiment of the present invention or hand held lighter 30 having a safety device. The lighter 30 comprises a main body 12, a trigger mechanism 10, a base 14 housing a fuel tank, and a barrel 16 with an a nozzle 18. In accordance with one embodiment of the present invention, the lighter further comprises a push button 32 on the main body 12 and a rotatable barrel section 35. Another embodiment, the preferred embodiment, does not include the push button 32.

In the one embodiment of the present invention, the push button 32 is located along the undercarriage of the main body 12 as shown. However, in the spirit of the invention, the push button may be located at any suitable position on the main body 12 or the barrel 16.

The push button 32 protrudes slightly from the main body 12. When the push button 32 is not engaged, depressing the trigger mechanism 10 is not possible. By preventing activation of the trigger mechanism 10, the flammable substance (fuel) is prevented from leaving the fuel tank and flowing through the fuel line 20. In the preferred embodiment, the trigger mechanism is depressible, but the lighter will not light simply by fully depressing the trigger, as describe in more detail below.

The push button 32 also controls the rotatability of the rotatable section 35. Rotation of the rotatable section 35 aligns the fuel line segment 37 in rotatable barrel section 35 with the fuel line segment 39 in main body portion 12 to form fuel line 20. By selectively preventing the rotation of the rotatable section 35, the fuel is selectively prevented from flowing through the barrel 16 and prevented from being ignited at nozzle 18.

Figure 3:
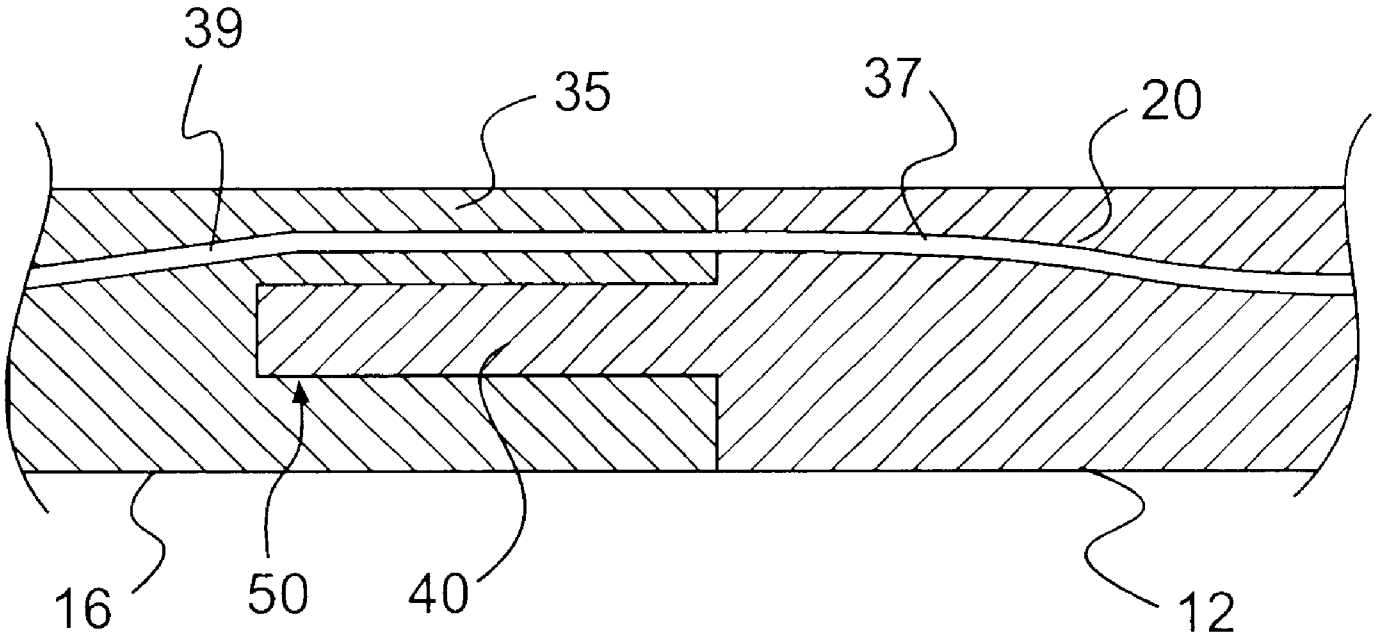
FIG. 3 is a partial cross-sectional view of the present invention.

Flow of the fuel through the barrel 16 and toward the nozzle 18 is achieved by aligning the segments 35 and 37 of the fuel line 20, as best seen in FIG. 3. FIG. 3 shows a cross-sectional portion of the main body 12 and rotatable section 35. The alignment of the aforementioned fuel line sections 37 and 39 can be achieved only by rotating the rotatable section 35 into a firing position. As depicted, the main body 12 has a male portion 40 extending outward from the center of the main body 12. The rotatable section 35 has a corresponding female portion 50 which mates with the male portion 40 to rotatably connect main portion 12 to rotatable section 35. The rotatable section 35 slides onto and is suitable attached, by any suitable locking means known in the art, to the male portion 40 such that the rotatable section 35 may rotate freely with respect to the main body 12. Any suitable bearing means could be used to facilitate rotation thereupon.

Figure 4B:
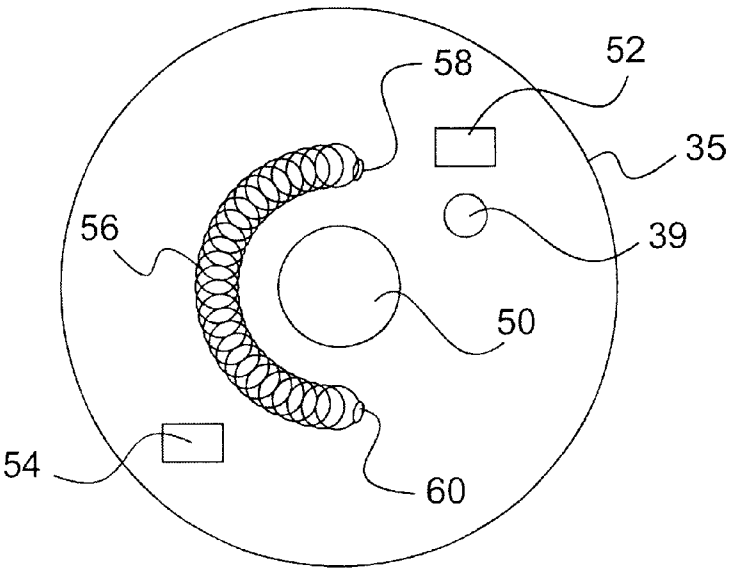
FIG. 4*b* is a side view of the rotatable section in a second position in accordance with the present invention.
Figure 4A:
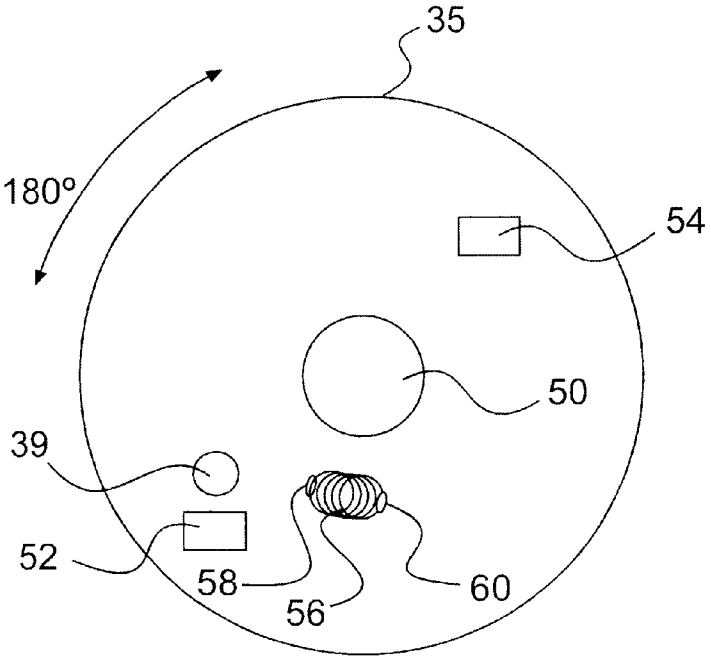
FIG. 4*a* is a side view of the rotatable section in a first position in accordance with the present invention.

Referring to FIGS. 4*a* and 4*b*, side views of the rotatable section 35 is depicted. As described above the rotatable section 35 has a female portion 50 which corresponds to the male portion 40 on the main body 12. The rotatable section 35 further contains a first and second notch 52 and 54 respectively. The first and second notches are located an equal distance from the center of the rotatable section 35, such that when section 35 is rotated from a first position (FIG. 4*a*) to a second position (FIG. 4*b*) to align fuel segments 37 and 39, notch 54 will move to a position where notch 52 initially was, as will be described in detail later. The rotatable section 35 has a fuel line section 39 which is a bore that extends throughout the length of the rotatable section 35. When the rotatable section 35 is aligned properly in its second position with the main body 12 such that section 39 is aligned with section 37 to complete fuel line 20, as shown and described in FIG. 3, fuel may flow freely from the fuel tank or chamber to the nozzle.

The rotatable section 35 also has a means for biasing, illustrated as a spring means 56. The spring 56 is suitably attached by a first leg 58 to the rotatable section 35 and a second leg 60 which is suitably attached to the main body 12. In use, the rotatable section 35 is selectively unlocked (as described below) and rotated from a first position (FIG. 4*a*) to a second position (FIG. 4*b*) and selectively locked therein. When in the first position (FIG. 4*a*) the fuel line section 39 is not aligned with the fuel line section 37. Furthermore, the spring 56 is not in tension. However, when the rotatable section 35 is rotated and locked in the second position (FIG. 4*b*), the fuel line section 39 is aligned with fuel line section 37. Also, the spring 56 is in tension such that when the rotatable section 35 is unlocked from the second position, the spring 56 rotates the rotatable section 35 back to the first position. It should be understood that any suitable seals and the like could be provided to allow for safe, leak-free operation of the lighter.

Figure 5A:
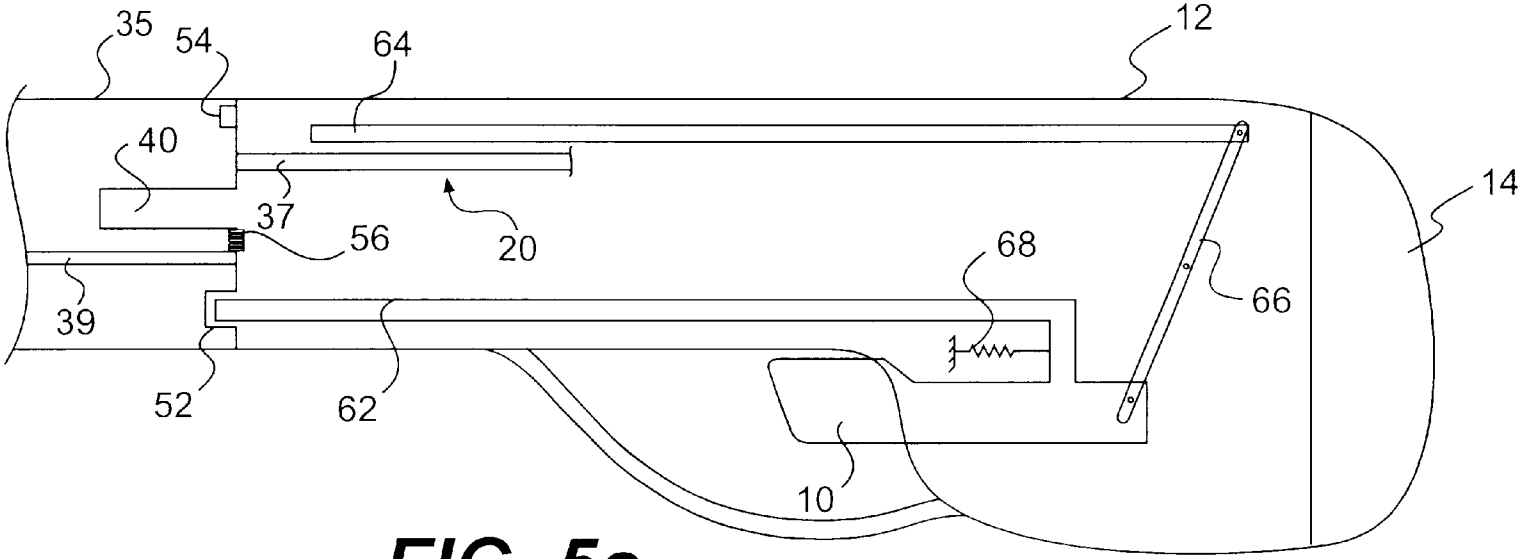
FIG. 5*a* is an enlarged skeletal view of the present invention.

The preferred embodiment of the present invention is illustrated in FIG. 5*a*. As can be seen, main body 12 is suitably mounted to rotatable barrel section 35. The barrel section 35 is in its first, non-operable position (FIG. 4*a*). A first locking bar 62 is suitably attached to the trigger mechanism 10, and locks rotatable barrel section 35 via engagement in notch 52. Trigger mechanism 10 and locking bar 62 are biased in this position by biasing means such as spring 68. Further attached to trigger mechanism 10 via link 66, pivotal about its midsection, is a second locking bar 64. In this position, locking bar 64 is aligned with but does not engage notch 54.

To light the lighter, trigger mechanism 10 is depressed slightly, not fully, such that locking bar 62 disengages from notch 52. Through the linkage, locking bar 64 moves closer to but does not engage notch 54. Thus, rotatable barrel section 35 is freed to be rotated to its second, operable position (FIG. 4*b*) wherein fuel line segments 37 and 39 are aligned. Once rotated to this position, the trigger mechanism can be fully depressed, moving locking bar 64 into engagement with notch 52, temporarily locking the rotating barrel section 35 in place, and igniting the lighter. When the trigger is released, locking bar 64 is retracted from notch 52, and the barrel section 35 is biased back to its first position, at which time locking bar 52 engages notch 52.

If when in the first position, the trigger mechanism is simply fully depressed without rotation of the barrel section 35, locking bar 64 will move into notch 54, thus preventing the barrel from rotating and preventing the lighter from lighting. Accordingly, the lighter can only be lit upon depressing the trigger mechanism slightly, rotating the barrel section, and then depressing the trigger mechanism fully.

Figure 5B:
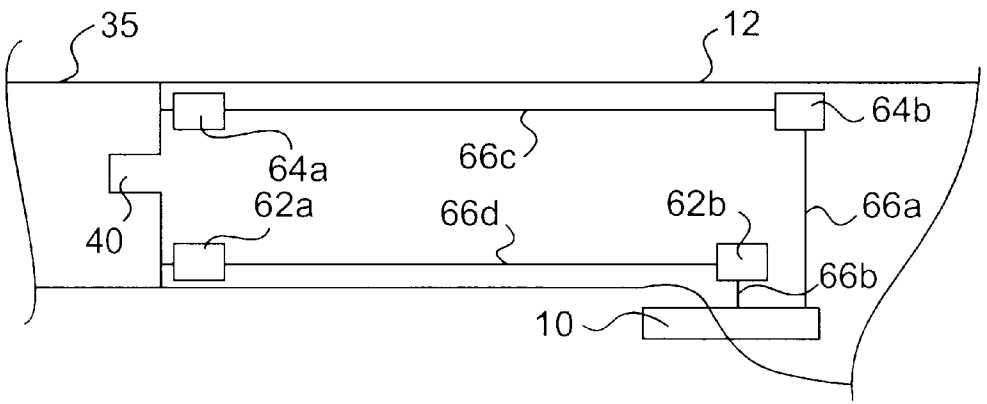
FIG. 5*b* is an enlarged schematic view of the present invention.

FIG. 5*b* illustrates the present invention schematically, wherein a first locking means 62*a* is operatively connected with a first means for signaling 62*b* via a means for communicating 66*d*. Means for signaling 62*b* is further operatively connected with trigger mechanism 10 via a means for communicating 66*b*. Similarly, a second locking means 64*a* is operatively connected with a second means for signaling 64*b* via a means for communicating 66*c*. Means for signaling 64*b* is further operatively connected with trigger mechanism 10 via a means for communicating 66*a*.

The means for locking could take any suitable form such as mechanical, electrical and/or electro-mechanical. The means for signaling could take any form such as sensors, position sensors, switches, toggles, etc. Means for communicating could likewise take any suitable form such as mechanical, electrical, infrared, etc.

Accordingly, for example, means for signaling 62*b* and 64*b* could take the form of sensors. Trigger mechanism could have sensing elements thereon at one or more locations. The means for signaling, upon sensing the sensing elements, could signal the means for locking in accordance with the novel aspects of the present invention. It should be understood that any suitable number of means for locking and means for signaling could be utilized, for example one of each, one means for signaling and two means for locking, two means for signaling and one means for locking, etc.

Referring now to FIGS. 5*c*-9, to light the lighter, first, the push button 32 is slid towards the base 14 of the main body 12, releasing a locking means 70 from notch 52, thereby unlocking the rotatable section 35. The rotatable section 35 is now free to rotate to the second position. When the rotatable section 35 is placed in the second position, the button 32 is released and the locking means 70 locks the rotatable section in the second position by engaging notch 54, shown in FIG. 9. As mentioned above, while in the second position the fuel is free to move through the sections of fuel line 20 when the trigger mechanism 10 is depressed. Thereafter, releasing the trigger mechanism 10 activates a releasing means 80 which retracts the locking means 70 from notch 54, thereby causing spring 56 to rotate the rotatable section back to the first position, as describe in more detail below. Thereafter, the locking means 70 re-engages notch 52, locking the rotatable section in its first position, requiring a user re-start the process over again.

Figure 5C:
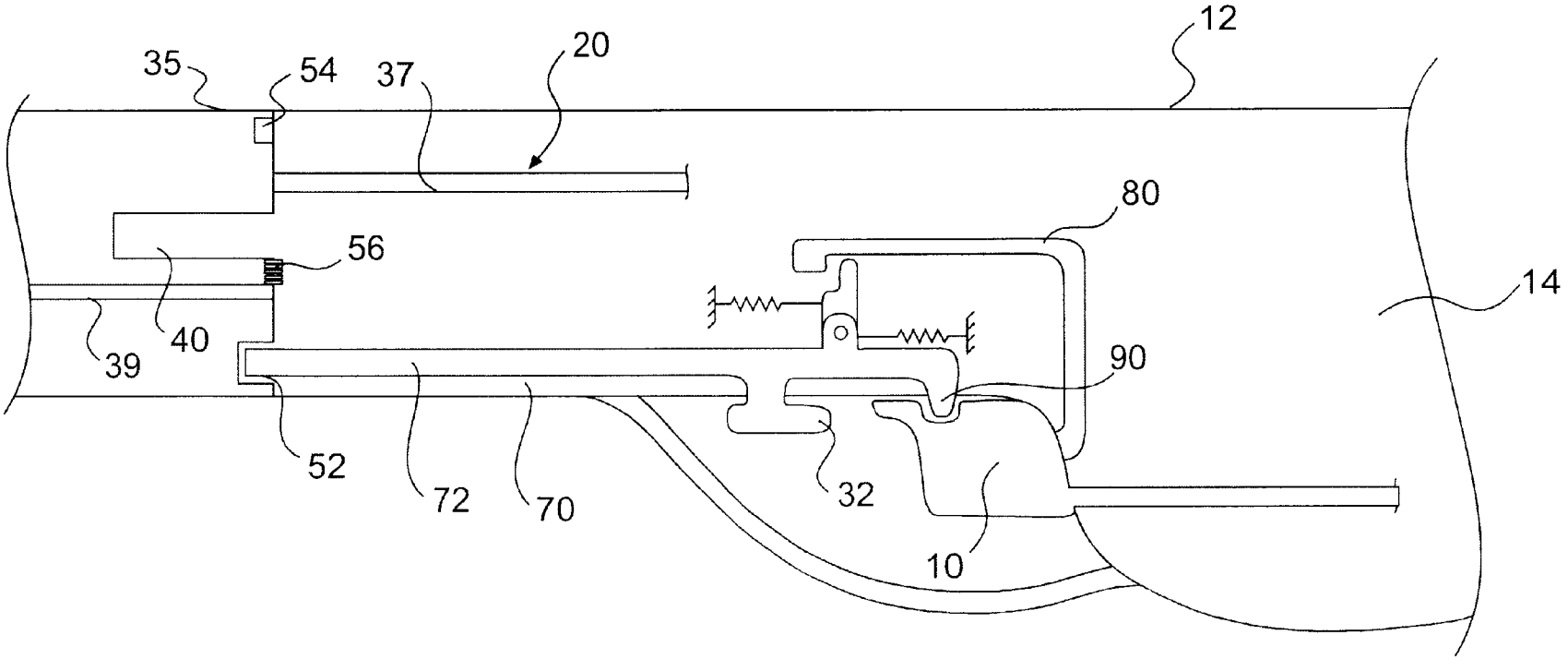
FIG. 5*c* is an enlarged skeletal view of an alternate embodiment of the present invention.

In greater detail, the first position is shown in FIG. 5*c*. The locking means 70 is made up of a locking member 72 which fits into the first notch 52. In the first position, the fuel line segment 39 is not aligned with the fuel line segment 37. Furthermore, the trigger mechanism 10 is also locked in place by a trigger locking means 90.

Figure 6:
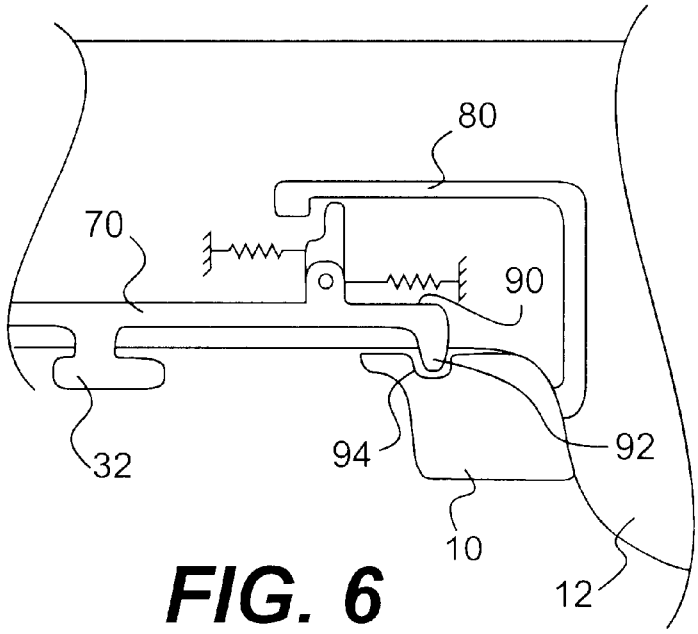
FIG. 6 is an elevational view showing the positional relationship between the locking means, the trigger mechanism, and the releasing means.
Figure 7:
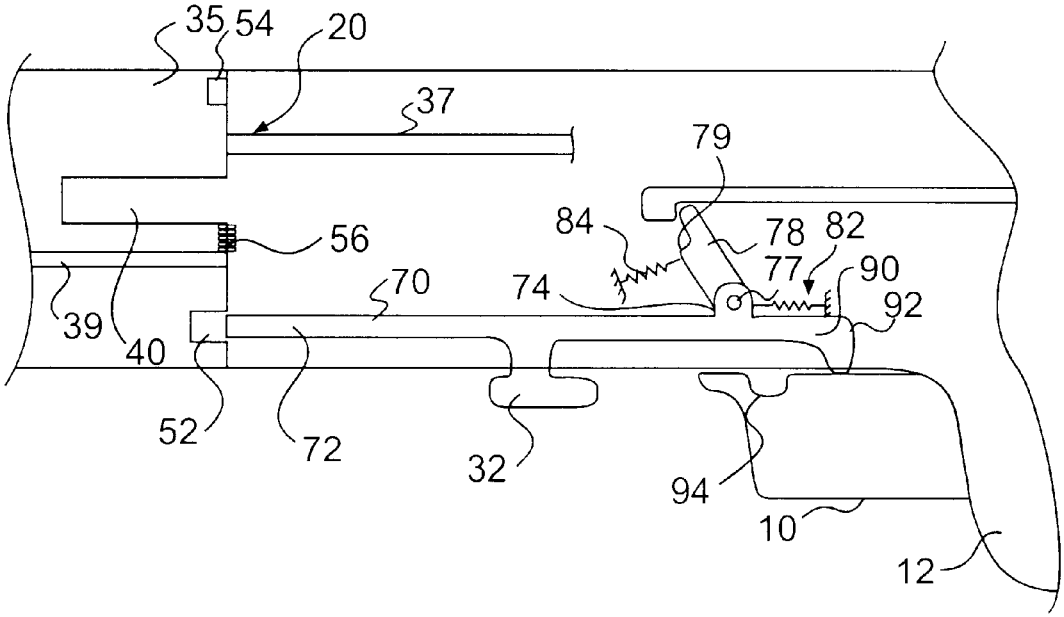
FIG. 7 is an enlarged skeletal view of the alternate embodiment of the present invention.

The trigger locking means 90, best seen in FIG. 6, is attached to the button 32. The trigger locking means 90 has an latching section 92 which locks into a notch 94 on the trigger mechanism 10. When the button 32 slides towards the base 14, the latching section 92 is pushed into the main body 12 and out of the notch 94, thereby releasing the trigger mechanism 10, as shown in FIG. 7. FIG. 7 also depicts that when the button 32 is slid, the locking member 72 slides out of notch 52, thereby releasing the rotatable section 35, thereby allowing a user to freely rotate the rotatable section to the second position.

Figure 8:
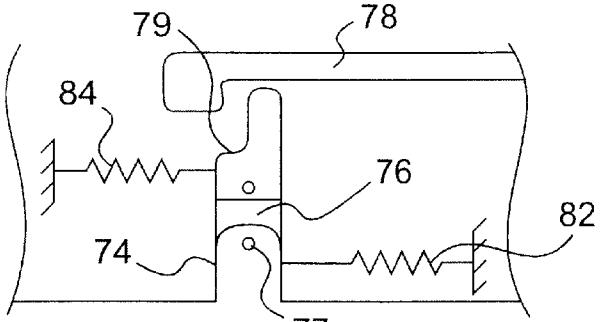
FIG. 8 is an exploded view of the positional relationship between the protruding member and the mating member.
Figure 9:
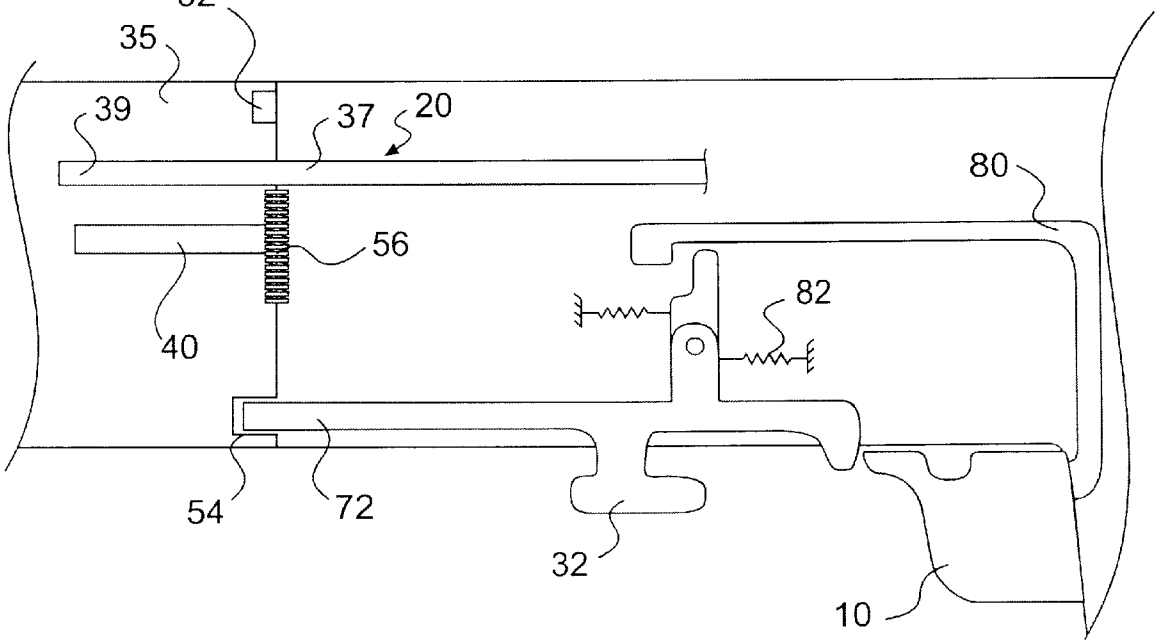
FIG. 9 is an enlarged skeletal view of the alternate embodiment of the present invention.

Also attached to the button 32 is a protruding member 74. The protruding member, best shown in FIG. 8, is made up of a U-shaped recess 76 and is attached via a pivot pin 77 to a mating member 78. The mating member 78 has a projecting member 79 for engaging the release means 80. Both the recess 76 and the mating member 78 are held in place by a first and second spring 82 and 84, respectively. Both the first and second springs are secured to the main body 12. The mating member 78 freely fits in the recess 76 and a pivot pin 77 is inserted thereto. In use the mating member 78 can pivot about pin 77 only from its vertical position shown in FIG. 6 towards rotating section 35. When attempting to pivot past its vertical position towards base 14, the mating member 78 contacts the U-shaped recess 76 and is prevented from such rotation.

As seen in FIG. 7, as the button 32 slides towards the base 14, the protruding member 74 also slides towards the base 14 against the bias of the first spring 82. The mating member 78 rotates about the pivot pin 77 while pushing against the second spring 84. The rotatable section 35 is now rotated against the tension of rotating spring 56 to a second position, seen in FIG. 9.

After the rotatable section 35 is rotated to its second position, the user lets go of the button 32, the first and second springs 82, 84 acting in concert push the button 32 back to its original position thereby pushing the locking member 72 into the second notch 54. Now that the rotatable section is in the second position, the fuel line section 37 is aligned with the fuel line section 39. While in the second position, the rotating spring 56 which is in tension, desires to rotate the rotatable section back to the first position, but is prevent by the locking member 72 in notch 54. Furthermore, in the second position the trigger mechanism 10 is free to be depressed, allowing the fuel to flow freely through the aligned fuel line to the nozzle.

Figure 10A:
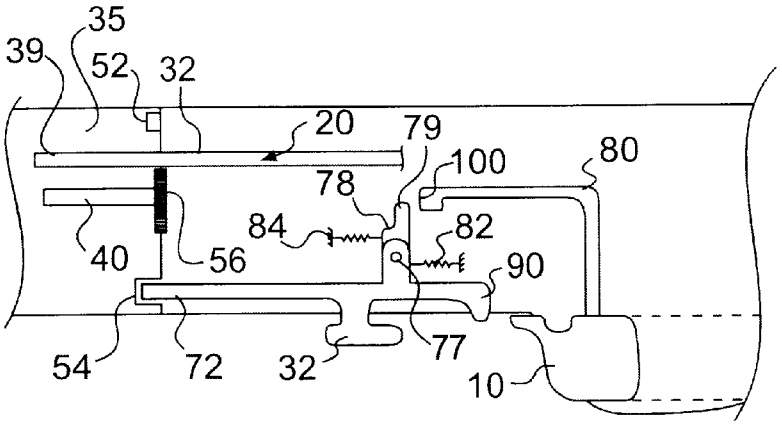
Figure 10*a* is a schematic view showing the positional relationship between the locking means and the releasing means.
Figure 10B:
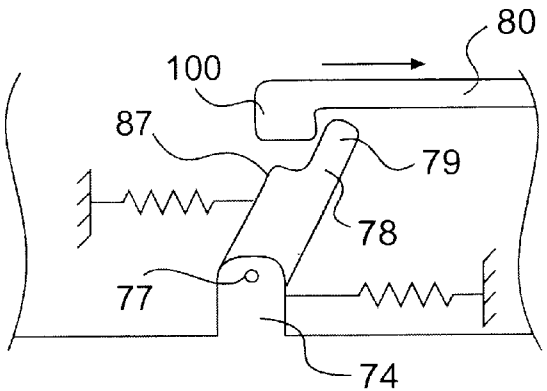
FIG. 10 is an enlarged skeletal view of the alternate embodiment of the present invention.

While depressing the trigger mechanism 10, best seen in FIG. 10, the release means 80 is depressed towards the base 14. The release means 80 has a projecting edge 100 which acts against the projecting member 79 on the mating member 78. As depicted in FIG. 10*a*, when the release means 80 is moving towards the base, the projecting edge 100 pushes against the projecting member 79. The projecting member 79 rotates about the pivot pin 77 allowing the projecting edge 100 to move with the trigger mechanism towards the base.

Figure 11:
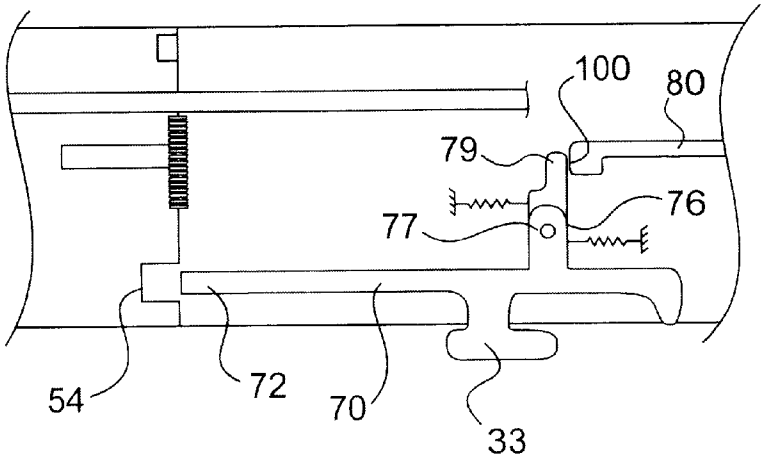
FIG. 11 is an enlarged skeletal view of the alternate embodiment of the present invention.

Referring now to FIG. 11, when the trigger mechanism 10 (not shown) is released the release means 80 releases the locking means 70 and the rotatable section rotates back to the first position. As shown, the projecting edge 100 presses against the projecting member 79. As described above the projecting member 79 is unable to pivot against the U-shaped recess 76 of the protruding member 74. In order to act against the force of the releasing means 80, the projecting member 79 will force the locking means 70 to slide towards the base 14. As such the locking member 72 is released from the second notch 54 and the spring 56 will rotate the rotatable section 35 back to the first position. The projecting edge 100 will pass over the projecting member 79 and then the first and second spring 82, 84 will return the locking means 70 to its original position, forcing the locking member 72 into the first notch 52, thereby relocking the rotatable section 35 and the trigger mechanism 10 in place. Thus a user is required to re-activate the child safety device in order to re-light the hand held lighter.

Figure 12:
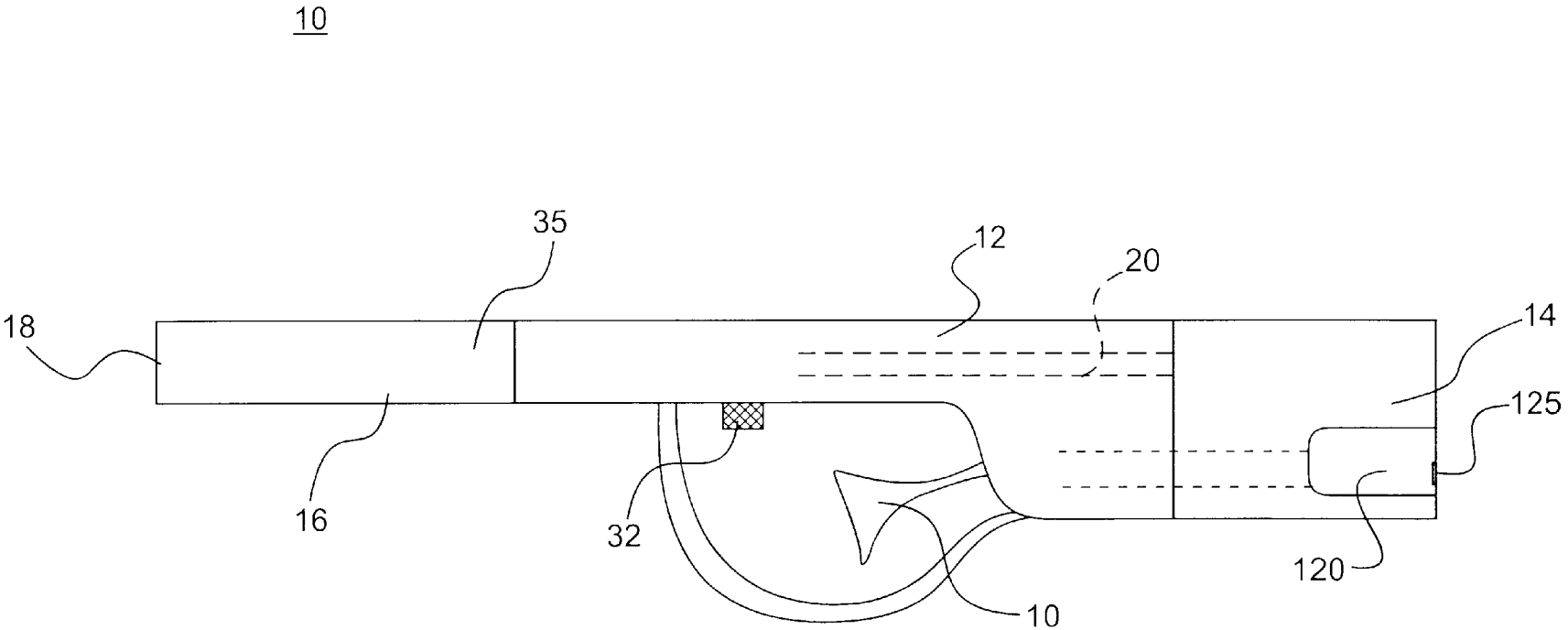
FIG. 12 is a profile view of another embodiment of the present invention.

Referring now to FIG. 12, a lighter according to another embodiment of the present invention is depicted, with a fuel tank 120 in the base 14 of the main body 12. Typical lighters made today are disposable. Once the fuel in the fuel tank runs out, the user must throw the lighter away and purchase a new one. FIG. 12 depicts a reusable child safety lighter. Once the fuel is depleted, the user can refill the fuel tank 120 via a fuel access port 125. Fuel access port 125 is preferably a one-way check valve to allow the insertion of a fueling device through which fuel can be inserted into the tank, and which prevents fuel for exiting the tank via the port. As such, the lighter is now more efficient and cost effective.

Figure 13:
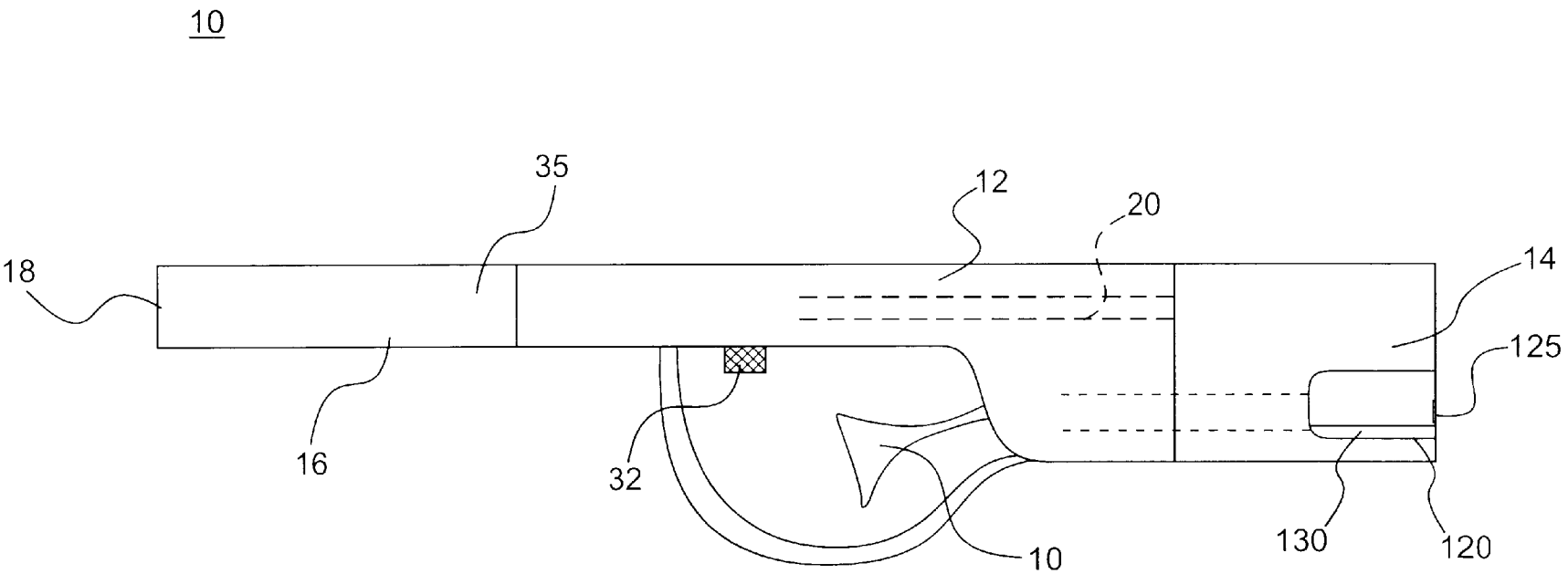
FIG. 13 is a profile view of another embodiment of the present invention.

Referring now to FIG. 13, another embodiment of a reusable child safety lighter is depicted. In order to reveal to a user when the fuel tank is running out or is low, the main body 12 can incorporate a measurement device 130, such as a fuel meter, or simply a view window if liquid fuel is used. The window is formed from transparent material which would allow the user to view the inside of the fuel tank 135.

The foregoing specification describes only the preferred embodiments of the invention as shown. Other embodiments besides those presented above may be articulated as well. The terms and expressions, therefore, serve only to describe the invention by example only and not to limit the invention. It is expected that others will perceive differences which, while differing from the foregoing, do not depart from the spirit and scope of the invention herein described and claimed.

What is claimed is:

1. A child safety device in a lighter, which gas lighter is provided with an end portion and a main body, the end portion being provided with a jetting nozzle for jetting out a fuel, the lighter further comprising:

said main body having a fuel chamber and a fuel line section;

a rotatable section having a fuel line section and being rotatably attached to said main body, said rotatable section having a first and second position; and a trigger mechanism attached to said fuel chamber;

whereas when the rotatable section is rotated from said first position to said second position the fuel line section of the rotatable section aligns with the fuel line section of the main body allowing for fuel to flow therethrough to said jetting nozzle.

2. The device of claim 1 further comprising:

at least one locking means releasably locking the rotatable section.

3. The device of claim 2 further comprising:

an urging means; and a release means attached to said trigger mechanism such that upon depressing and releasing said trigger mechanism said release means unlocks said locking means, urging said urging means to rotate said rotatable section to from said second position to said first position thereby un-aligning said fuel line sections.

4. The device of claim 3 further comprising:

an engagement means attached to said locking means;

said engagement means releasably locking said trigger mechanism, such that while said locking means is locking said rotatable section in said first position, said engagement means locks said trigger mechanism.

5. The device of claim 4 wherein said urging means comprises a spring having a first and second leg, said first leg attached to said rotatable section and said second leg attached to said main body.

6. The device of claim 5 further comprising:

a first and second notch on said rotatable section corresponding to said first and second position respectively; and a locking member extending from said locking means, wherein said locking member engages said first notch locking said rotatable section in said first position and said locking member engaging said second notch locking said rotatable section in said second position.

7. The device of claim 1 further comprising:

a circular member extending from said main body; and said rotatable section further comprising a bore corresponding in size and shape to said circular member, wherein said rotatable section fits onto said circular member such that the rotatable section may rotate freely about said circular member.

8. The device of claim 7 wherein said fuel tank includes a fuel access port.

9. The device of claim 8 wherein said main body includes a transparent window by said fuel tank, and said fuel tank being made of a transparent material, such that the contents of said fuel tank can be viewed through said transparent window.

10. A child safety device in a lighter, which lighter is provided with an end portion and a main body, the end portion being provided with a jetting nozzle for jetting out a fuel, the lighter further comprising:

said main body having a fuel tank and a fuel line section;

a trigger mechanism for controlling the release of said fuel through said pipe;

said fuel tank having a fuel access port; and said main body having a transparent window by said fuel tank, and said fuel tank being made of a transparent material, such that the contents of said fuel tank can be viewed through said transparent window;

a rotatable section having a fuel line section and being rotatably attached to said main body, said rotatable section having a first and second position, such that when the rotatable section is rotated from said first position to said second position said fuel line section of said rotatable section aligns with said fuel line section of said main body for said fuel to flow therethrough to said jetting nozzle;

a locking means releasably locking the rotatable section; and a release means attached to said trigger mechanism such that upon depressing and releasing said trigger mechanism said release means unlocks said locking means, urging said rotatable section from said second position to said first position thereby unaligning aligning said fuel line sections.

11. The device of claim 11 further comprising:

an engagement means attached to said locking means;

said engagement means releasably locking said trigger mechanism, such that while said locking means is locking said rotatable section in said first position said engagement means locks said trigger mechanism.

12. The device of claim 11 further comprising:

a first and second notch on said rotatable section corresponding to said first and second position respectively; and a locking member extending from said locking means, wherein said locking member engages said first notch locking said rotatable section in said first position and said locking member engaging said second notch locking said rotatable section in said second position.

13. The device of claim 12 further comprising:

a circular member extending from said main body; and said rotatable section further comprising a bore corresponding in size and shape to said circular member, wherein said rotatable section fits onto said circular member such that the rotatable section may rotate freely about said circular member.

14. A lighter comprising:

a main portion having a fuel line segment;

a barrel portion operatively mounted to said main portion and having a fuel line segment, said barrel portion having an axis;

a trigger mechanism operatively mounted to said main portion; and a safety mechanism in said lighter for selectively allowing ignition of the lighter upon manipulation of both said barrel portion and said trigger mechanism, wherein said barrel portion is selectively rotatable about its axis to align said fuel line segments.

15. The lighter of claim 14, wherein said safety mechanism includes a first locking bar and a second locking bar operatively connected to said trigger mechanism.

16. The lighter of claim 15, wherein said barrel portion has a first position wherein said fuel line segments are unaligned, and said first locking portion engages said barrel portion.

17. The lighter of claim 16, wherein said barrel portion has a second position wherein said fuel line segments are aligned, and said second locking portion engages said barrel portion.

18. The lighter of claim 17, wherein said barrel portion is rotatable from said first position to said second position only upon said trigger mechanism being slightly depressed.

* * * * *